US007140435B2

(12) United States Patent
Defretin et al.

(10) Patent No.: US 7,140,435 B2
(45) Date of Patent: Nov. 28, 2006

(54) OPTICAL FIBER CONVEYANCE, TELEMETRY, AND/OR ACTUATION

(75) Inventors: Harmel Defretin, Sugar Land, TX (US); Gordon B. Duncan, Montrose (GB); Nicolas G. Pacault, Houston, TX (US); Christian Koeniger, Langen (DE); Nigel D. Leggett, Southampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 257 days.

(21) Appl. No.: 10/652,845

(22) Filed: Aug. 29, 2003

(65) Prior Publication Data

US 2005/0034857 A1 Feb. 17, 2005

Related U.S. Application Data

(60) Provisional application No. 60/434,093, filed on Dec. 17, 2002, provisional application No. 60/407,084, filed on Aug. 30, 2002.

(51) Int. Cl.
*E21B 47/12* (2006.01)

(52) U.S. Cl. ..... 166/255.1; 385/102; 340/854.1

(58) Field of Classification Search ..... 166/255.1, 166/255.2; 385/100, 102; 340/854.1, 855.7
See application file for complete search history.

(56) References Cited

U.S. PATENT DOCUMENTS

| | | | | |
|---|---|---|---|---|
| 4,057,781 | A | 11/1977 | Scherbatskoy | |
| 4,162,400 | A | 7/1979 | Pitts, Jr. | |
| 4,389,645 | A * | 6/1983 | Wharton | 340/854.7 |
| 4,696,542 | A * | 9/1987 | Thompson | 385/108 |
| 5,159,978 | A | 11/1992 | Tomek et al. | |
| 5,234,058 | A | 8/1993 | Sas-Jaworsky et al. | |
| 5,275,038 | A | 1/1994 | Sizer et al. | |
| 5,361,838 | A | 11/1994 | Kilgore | |
| 5,429,190 | A | 7/1995 | Kilgore et al. | |
| 5,435,395 | A | 7/1995 | Connell | |
| 5,495,755 | A | 3/1996 | Moore | |
| 5,512,889 | A | 4/1996 | Fletcher | |
| 5,587,707 | A | 12/1996 | Dickie et al. | |
| 5,850,879 | A | 12/1998 | Smith | |
| 5,898,517 | A | 4/1999 | Weis | |
| 5,917,160 | A * | 6/1999 | Bailey | 181/112 |
| 6,041,872 | A | 3/2000 | Holcomb | |
| 6,072,567 | A | 6/2000 | Sapack | |
| 6,173,773 | B1 * | 1/2001 | Almaguer et al. | 166/255.2 |

(Continued)

FOREIGN PATENT DOCUMENTS

GB 2275953 A 9/1994

(Continued)

OTHER PUBLICATIONS

Sensa Systems, The World's Smallest Logging Unit, Kwiglog Brochure.

(Continued)

*Primary Examiner*—David Bagnell
*Assistant Examiner*—Daniel P Stephenson
(74) *Attorney, Agent, or Firm*—Trop, Pruner & Hu, P.C.; Bryan P. Galloway; Jaime A. Castano

(57) ABSTRACT

Methods and apparatus comprise a conveyance structure to carry a tool into a wellbore. The conveyance structure contains an optical fiber line to enable communication between the tool and well surface equipment. In one implementation, the conveyance structure comprises a slickline. In another implementation, the conveyance structure includes another type of conveyance device that does not convey power and data separate from the fiber optic line.

27 Claims, 7 Drawing Sheets

U.S. PATENT DOCUMENTS

| | | | | |
|---|---|---|---|---|
| 6,271,766 | B1 | 8/2001 | Didden et al. | |
| 6,274,816 | B1 * | 8/2001 | Kendall, Jr. | 174/84 R |
| 6,281,489 | B1 | 8/2001 | Tubel et al. | |
| 6,341,652 | B1 | 1/2002 | Malone et al. | |
| 6,355,928 | B1 | 3/2002 | Skinner et al. | |
| 6,520,264 | B1 | 2/2003 | MacKenzie et al. | |
| 6,557,249 | B1 | 5/2003 | Pruett et al. | |
| 2005/0034857 | A1 | 2/2005 | Defretin | |

FOREIGN PATENT DOCUMENTS

| | | | |
|---|---|---|---|
| GB | 2 337 579 | | 11/1999 |
| GB | 2 337 593 | | 11/1999 |
| GB | 2364380 | A | 1/2002 |
| JP | 1-121492 | | 5/1989 |
| JP | 8165879 | A | 6/1996 |
| RU | 2 167 287 | | 5/2001 |
| RU | 2 177 676 | | 12/2001 |
| SU | 1446583 | | 12/1988 |
| WO | WO 03/021301 | A2 | 3/2003 |
| WO | WO 03/042498 | A1 | 5/2003 |
| WO | WO 2004/020774 | | 3/2004 |
| WO | WO 2004/020789 | A3 | 3/2004 |

OTHER PUBLICATIONS

T. Ockosi et al., "Optical Fiber Sensors," L. "Energoisdat," 1995, p. 145.

Translation of Official Action from couterpart Russian Application No. 2003126582/28(028360), dated Feb. 7, 2005.

* cited by examiner

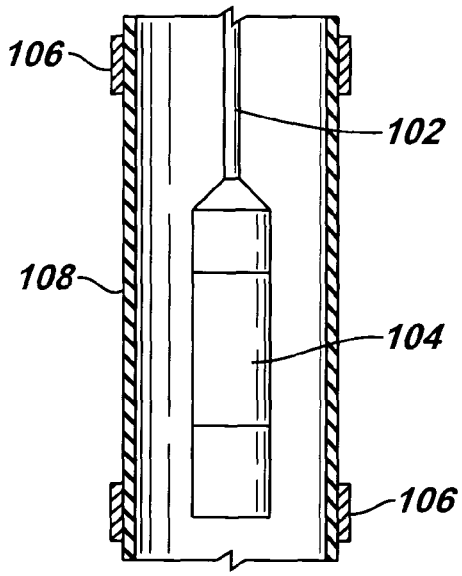
FIG. 3
FIG. 4
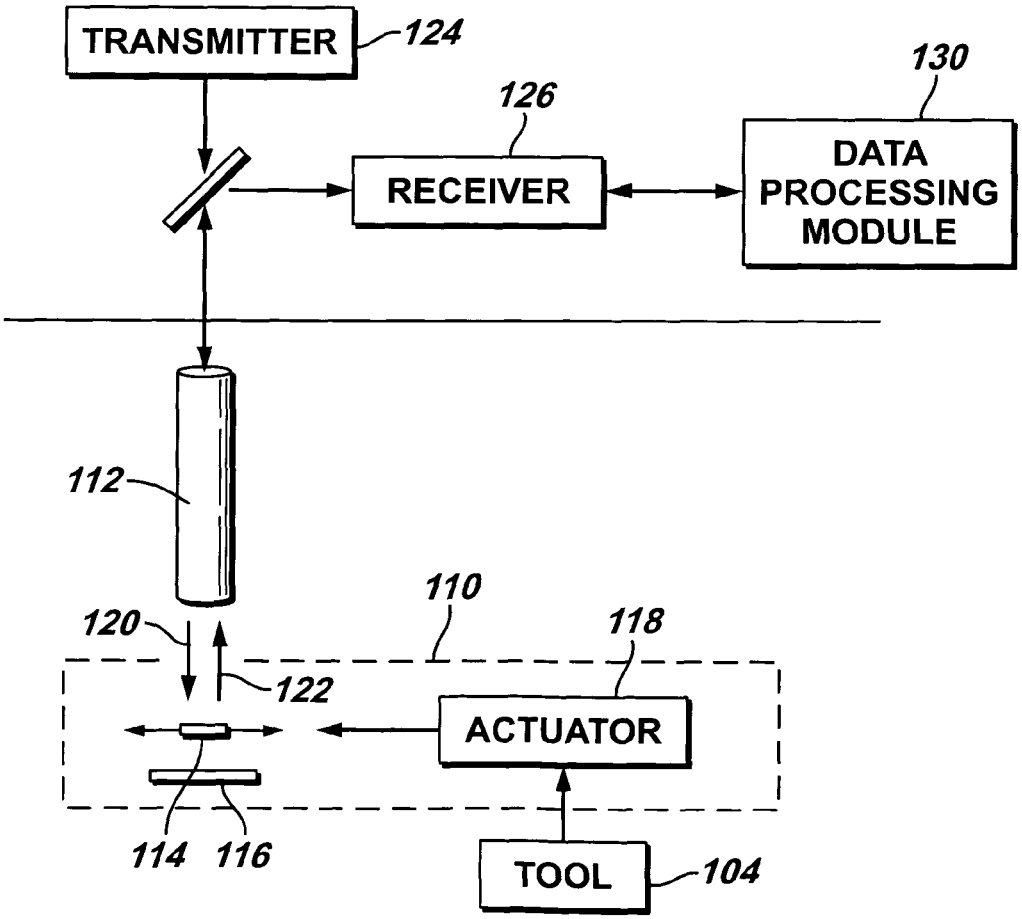

OPTICAL FIBER CONVEYANCE, TELEMETRY, AND/OR ACTUATION

CROSS REFERENCE TO RELATED APPLICATIONS

This claims the benefit under 35 U.S.C. § 119(e) of: U.S. Provisional Application Ser. No. 60/407,084, entitled "Optical Fiber Conveyance, Telemetry, and Actuation," filed Aug. 30, 2002; and U.S. Provisional Application Ser. No. 60/434,093, entitled "Method and Apparatus for Logging a Well Using a Fiber Optic Line and Sensors," filed Dec. 17, 2002.

BACKGROUND

A well is typically completed by installing a casing string into a wellbore. Production equipment can then be installed into the well to enable production of hydrocarbons from one or more production zones in the well. In performing downhole operations, communications between a downhole component and surface equipment is often performed.

A common type of communications link includes a wireline in which one or more electrical conductors route power and data between a downhole component and the surface equipment. Other conveyance structures can also carry electrical conductors to enable power and data communications between a downhole component and surface equipment. To communicate over an electrical conductor, a downhole component typically includes electrical circuitry and sometimes power sources such as batteries. Such electrical circuitry and power sources are prone to failure for extended periods of time in the typically harsh environment (high temperature and pressure) that is present in a wellbore.

Another issue associated with running electrical conductors in a wireline, or other type of conveyance structure, is that in many cases the wireline extends a relatively long length (thousands to tens of thousands of feet). The resistance present in such a long electrical conductor is quite high, which results in high electrical power dissipation in the long conductor. As a result, surface units of relatively high power are typically used in a well application to enable communications along the electrical conductors.

To address some of the issues associated with use of electrical conductors to communicate in a wellbore, optical fibers are used. Communication over an optical fiber is accomplished by using an optical transmitter to generate and transmit laser light pulses that are communicated through the optical fiber. Downhole components can be coupled to the optical fiber to enable communication between the downhole components and surface equipment. Examples of such downhole components include sensors, gauges, or other measurement devices.

Typically, an optical fiber is deployed by inserting the optical fiber into a control line, such as a steel control line, that is run along the length of other tubing (e.g., production tubing). The control line is provided as part of a production string that is extended into the wellbore. Although extending optical fibers through a control line have been proved to be quite useful in many applications, such control lines are generally not useful in other applications. For example, in some cases, it may be desired to run an intervention, remedial, or investigative tool into a wellbore. Conventionally, such intervention, remedial, or investigative tools are carried by a wireline, slickline, coiled tubing, or some other type of conveyance structure. If communication is desired between the intervention, remedial, or investigative tool and the surface equipment, electrical conductors are run through the conveyance structure. As noted above, electrical conductors are associated with various issues that may prove impractical in some applications.

SUMMARY

In general, methods and apparatus are provided for improved communications techniques between surface equipment and downhole components. For example, according to one embodiment, an apparatus for use in a well includes a slickline having a fiber optic line therein. In another embodiment, an apparatus for use in a well includes a conveyance structure and a fiber optic line extending through the conveyance structure, where the conveyance structure is not used to transmit power or data therethrough.

Other or alternative features will become apparent from the following description, from the drawings, and from the claims.

BRIEF DESCRIPTION OF THE DRAWINGS

FIGS. 3 is a schematic diagram of a tool string that employs a conveyance structure according to some embodiments and a tool attached to the conveyance structure.

FIG. 4 is a schematic diagram of a system including a casing collar locator coupled to a conveyance structure having a fiber optic line

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Various types of services are performed in a well to enhance production of hydrocarbons or to repair problem areas in the well. To perform a service, a tool is lowered into the wellbore. Depth correlation is one such service performed during well intervention to enable a well operator to know the depth of a tool within the wellbore. Additionally, other types of tools may include other types of sensors to collect data regarding a well. Moreover, in some cases, it may be desirable to attach a tool that performs some type of task in the wellbore, such a packer to seal off a region in the wellbore, a perforating gun to create perforations, a logging tool to make measurements, and so forth.

A tools is carried by a conveyance structure into the wellbore. In accordance with some embodiments of the invention, an optical fiber is provided through the conveyance structure to enable efficient communication between the intervention tool and earth or well surface equipment. According to one embodiment, the conveyance structure is a slickline. In other embodiments, other types of conveyance structures are employed, as further described below.

Figure 1:
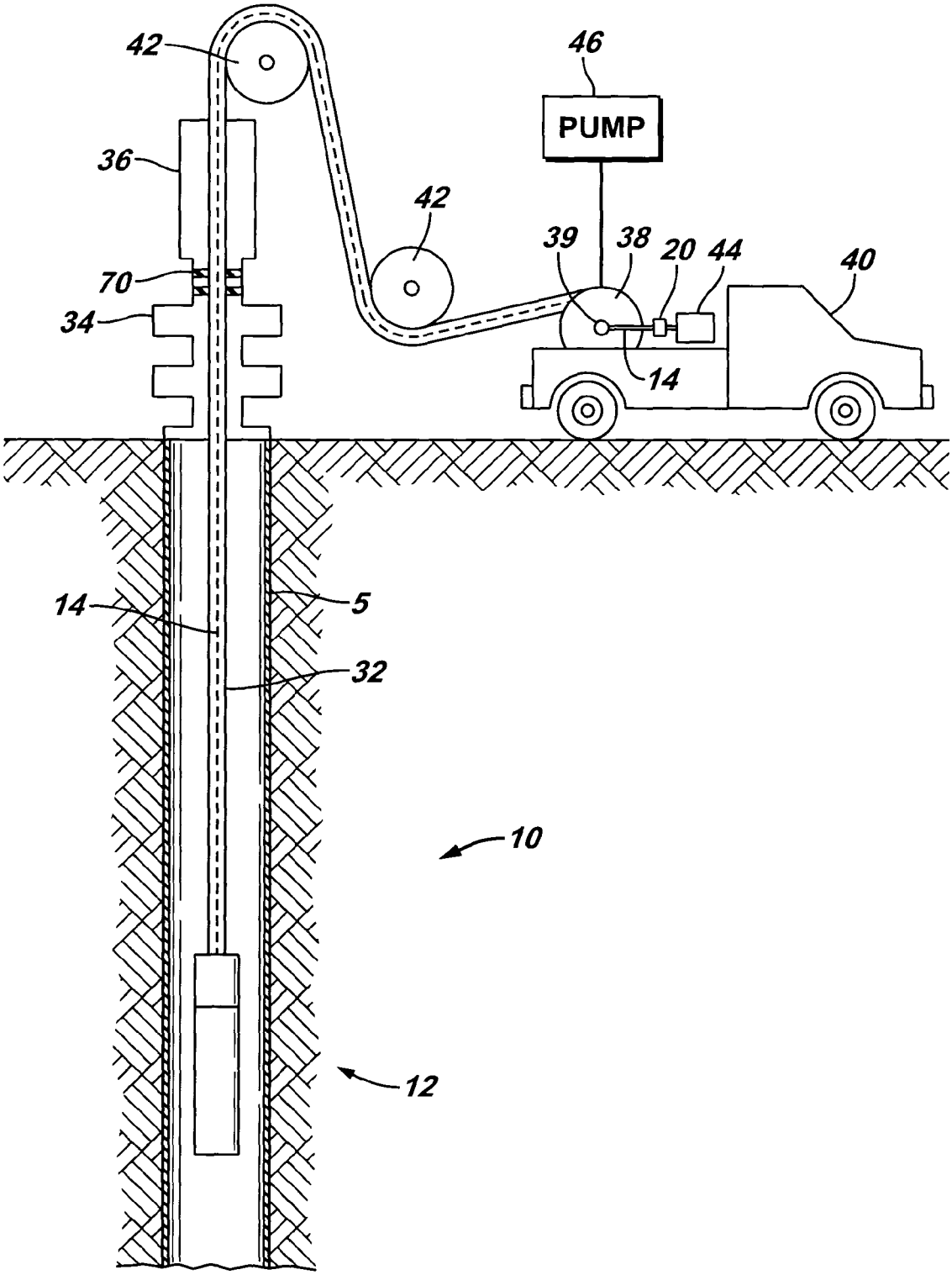
FIG. 1 is a schematic diagram of a system incorporating a conveyance structure according to one embodiment of the present invention.

Referring to FIG. 1, according to one embodiment of the present invention, an optical fiber line 14 is disposed in a slickline 32. In general, a slickline is a conveyance line used in a well that does not provide for electrical communication along the line. Typically, an electric wireline has one or more conductors therein, which are often formed of copper that may provide communication of power, telemetry, or both. By contrast, a slickline does not have electrical conductors therein that are used for power or data telemetry. As used herein, a slickline may be formed of a material capable of conducting electricity, such as metal, but the metal portions are not used for telemetry or transmission of electricity. Instead, the slickline is used for conveyance and support of tools into and from a well.

In one embodiment, the outer surface of the slickline is smooth so that the frictional force in raising and lowering the slickline is relatively low. Additionally, the pressure control equipment for controlling well pressure can be less complex than that required to deploy an electric wireline.

The slickline 32 may be capable of conveying significant loads. In one embodiment, the slickline is capable of supporting a load of at least about 500 pounds or higher. The load support is achieved by utilizing a slickline that does not have the conductive copper wires but rather uses steel or composite materials capable of supporting a high load. A further benefit of using slicklines to convey an optical fiber line is that slicklines are relatively cost effective. Also, existing wellhead equipment can be used without significant modification.

Alternatively, the slickline 32 can be replaced with other type of conveyance structures having a bore through which one or more fiber optic lines can be disposed.

Wellhead 34 is located at the top of wellbore 5. Slickline 32 with fiber optic line 14 therein is passed through a stuffing box 36 (or a packing or lubricator) located at wellhead 34. Stuffing box 36 provides a seal against slickline 32 so as to safely allow the deployment of tool 12 even if wellbore 5 is pressurized. In one embodiment, at least one additional seal 70, such as an elastomeric seal, can be located below the stuffing box 36 to provide an additional sealing engagement against the slickline 32 in order to prevent leaks from the pressurized wellbore.

Slickline 32 may be deployed from a reel 38 that may be located on a vehicle 40. Several pulleys 42 may be used to guide the conduit 32 from the reel 38 into the wellbore 5 through the stuffing box 36 and wellhead 34. Based on the size of the conduit 32, deployment of some embodiments of the invention does not require a coiled tubing unit nor a large winch truck. Reel 38, in one embodiment, has a diameter of 20 inches or less. Being able to use a relatively smaller reel and vehicle dramatically reduces the cost of the operation.

Fiber optic line 14 is connected to a receiver 44 that may be located on the vehicle 40. Receiver 44 receives the optical signals sent from the tool 12 through the fiber optic line 14. Receiver 44, which includes a microprocessor and an optoelectronic unit, converts the optical signals back to electrical signals and then delivers the data (the electrical signals) to the user. Delivery to the user can be in the form of graphical display on a computer screen or a print out or the raw data transmitted from the tool 12. In another embodiment, receiver 44 is a computer unit, or is attached or otherwise coupled to a computer unit, such as a portable computer, personal digital assistant (PDA) device, and so forth, that plugs into the fiber optic line 14. In each embodiment, the receiver 44 processes the optical signals or data to provide the selected data output to the well operator. The processing can include data filtering and analysis to facilitate viewing of the data.

An optical slip ring 39 is functionally attached to the reel 38 and enables the connection of the fiber optic line 14 to the receiver 44. The optical slip ring 39 interfaces between the fiber optic line 14 inside of the conduit 32 at the reel 38. As the reel 38 turns, the slip ring 39 does not. The slip ring 39 thus facilitates the transmission of the real time optical data from the dynamically moving reel 38 and fiber optic line 14 therein to the stationary receiver 44. In short, the slip ring 39 allows for the communication of optical data between a stationary optical fiber, and a rotating optical fiber.

Pulses of light at a fixed wavelength are transmitted from the optical transmitter 20 through the fiber optic line 14. The optical transmitter may be located at surface or downhole depending upon the application. In some implementations, an optical transmitter is not provided at the tool 12. In such implementations, the tool 12 includes a modulator that changes (or moderates) characteristics of the light such that the light reflected back through the fiber optic line is altered. The receiver 44 is capable of detecting and interpreting the changed or modulated optical signal.

The slickline 32 supports the well tool 12 attached to a lower end thereof. In one embodiment, the tool 12 is powered by a downhole power source such as a battery, a fuel cell, or other downhole power source. In another embodiment, the tool does not have an electric power source. In yet another embodiment, the tool 12 is powered by light supplied through the fiber optic line. "Powered by light" refers to the process of converting optical energy into mechanical or electrical energy. There are numerous ways to achieve this. Data is telemetered via the fiber optic line to/from the tool.

Figure 2A:
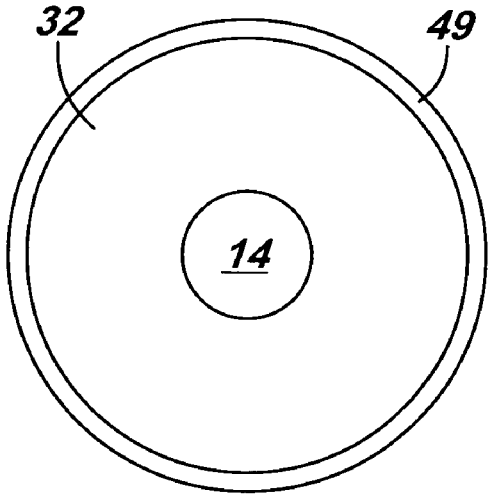
FIGS. 2A–C are cross-sectional views of various embodiments of the conveyance structure of FIG. 1 that includes a slickline having a fiber optic line therein.

FIG. 2A shows a cross-sectional view of the slickline 32, which encloses the fiber optic line 14. The fiber optic line 14 extends generally down a bore near the center of the slickline 32. However, in other embodiments, the fiber optic line 14 may be offset from the center. In yet other embodiments, multiple fiber optic lines 14 can be routed through the slickline 32. The slickline 32 may be coated with an insulating, protective, or wear resistant material 49.

Figure 2B:
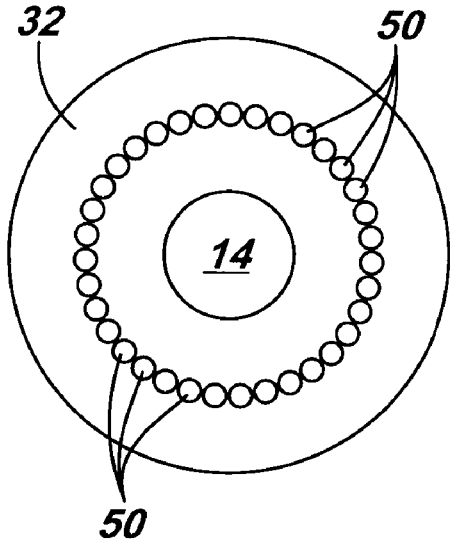

FIG. 2B shows an alternative embodiment in which the slickline comprises a plurality of longitudinally-extending support fibers 50 (which may extend helically or in some other path) that add to the overall strength and load capacity of the slickline.

Figure 2C:
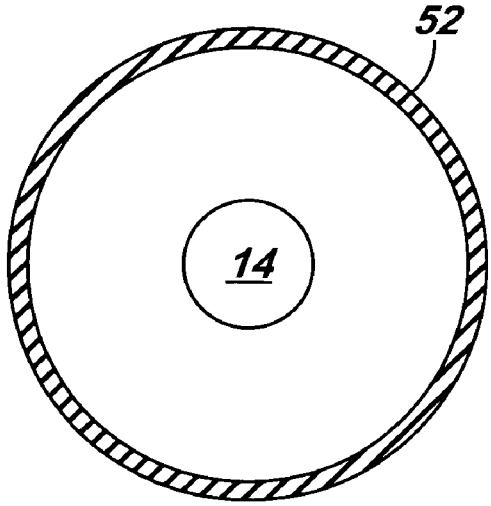

FIG. 2C shows an alternative conveyance device comprising a small diameter tubing 52 (instead of the slickline 32 of FIGS. 2A, 2B) having the fiber optic line 14 disposed therein. The conveyance tube 52 is formed of a high strength material capable of withstanding the harsh downhole environments, such as INCALOY or a steel alloy, as some examples. The conveyance tube 52 is flexible enough that it may be wound upon a reel for ease of transport and deployment. Additionally, the conveyance tube 52 is sufficiently strong to support a relatively high load. However, the conveyance tube 52 differs from a coiled tubing in that the diameter of the conveyance tube is significantly smaller than a coiled tubing. In one embodiment, the conveyance tube has a diameter that is less than about ½ inch. Coiled tubing also has substantial wall thickness, leaving small internal diameters not designed for flow or pumping.

Although the conveyance tube 52 may be formed by any conventional method, in one embodiment, the tube is formed by wrapping a flat plate around a fiber optic line. In another embodiment, the fiber optic line is installed in the tube by pumping the fiber optic line into the conveyance tube 52. Essentially, the fiber optic line 14 is dragged along the conduit 52 by the injection of a fluid at the surface, such as injection of fluid (gas or liquid) by pump 46 (FIG. 1). The fluid and induced injection pressure work to drag the fiber optic line 14 along the conduit 52.

According to some embodiments, a characteristic of the conveyance tube 52 or the slickline 32 is that the conveyance tube 52 or slickline 32 is not used to transmit power or data therethrough (except through the fiber optic line 14). In other words, the conveyance tube 52 or slickline 32 constitutes a conveyance structure to carry a tool into a wellbore, with the conveyance structure not including a power or data communication line (such as an electrical conductor) separate from the fiber optic line 14 (or plural fiber optic lines).

As shown in FIG. 3, one example of a tool that is run into a wellbore on a conveyance structure 102 containing a fiber optic line is a casing collar locator 104. The casing collar locator 104 can be part of a larger tool string containing other tools, such as perforating tools, packers, valves, logging tools, and so forth. The casing collar locator 104 detects for collars 106 in casing 108 that lines the wellbore. Detection of a collar 106 is communicated by modulating light reflected back to the surface through the fiber optic line in the conveyance structure 102.

FIG. 4 depicts a schematic representation of the casing collar locator system according to one embodiment. Interface components 110 are provided between the casing collar locator 102 and a fiber optic line 112 in the conveyance structure 102.

The interface components include a mirror 116 (or other reflective device) at the lower end of the fiber optic line. An obstacle 114 is provided between the fiber optic line 112 and the mirror 116. The mirror 116 and obstacle 114 are moveable with respect to each other. An actuator 118 is coupled to one or both of the obstacle 114 and mirror 116 to move the one or both of the obstacle 114 and mirror 116. The actuator 118 receives data from the casing collar locator 104. When a collar 106 (FIG. 3) is detected (collar 106 is in close proximity to the casing collar locator 104), the detection of the collar 106 is communicated to the actuator 118. The actuator 118, which can be powered by a local power source such as battery, causes movement of the obstacle 114 and/or mirror 116. In one embodiment, the obstacle 114 includes a magnet that is moveable by magnetic forces generated by the actuator 118. In other embodiments, other mechanisms for moving the magnet 114 and/or mirror 116 are used. The obstacle 114 and mirror 116 form a modulator that modulates an optical signal within the fiber optic line to indicate a state of the casing collar locator.

In an alternative embodiment, the actuator 118 can be omitted. Instead, the obstacle 114 includes a magnet that is moveable due to proximity of the obstacle to a collar 106. In this alternative embodiment, the assembly of the obstacle 114 and the mirror 116 can be the casing collar locator, so that a separate casing collar locator 104 is not needed.

Figure 5:
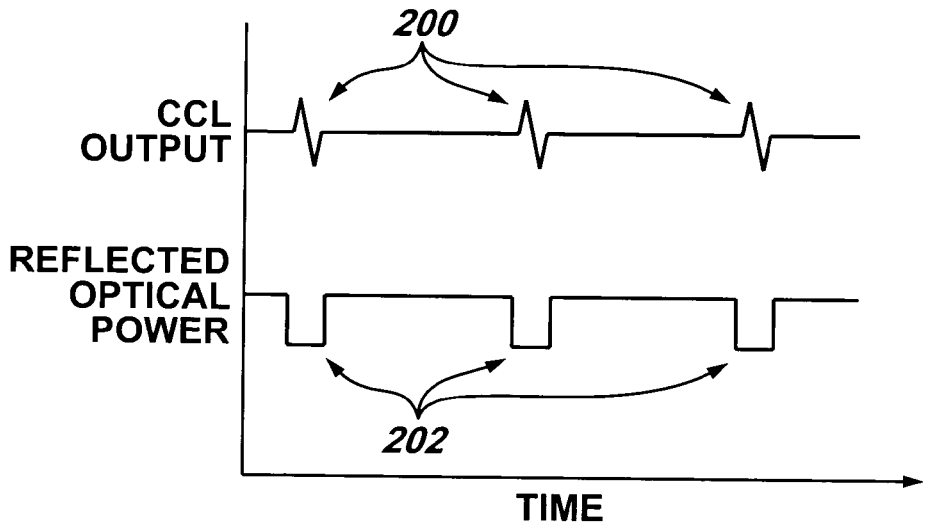
FIG. 5 is a timing diagram of light pulses reflected back from a casing collar locator along a fiber optic line, in accordance with an embodiment.

Relative movement of the mirror 116 and the obstacle 114 changes the light reflected back through the fiber optic line 112. A timing diagram illustrating detection of casing collars 106 is shown in FIG. 5. The output of the casing collar locator 104 is pulsed upon detection of collars, as indicated by pulses 200. Light is transmitted from a surface optical transmitter 124 into the fiber optic line 112. The transmitted light is received as incoming light 120 at the interface components 110, and reflected back as reflected light 122. Normally, when the casing collar locator 104 is not in the presence of a casing collar 106, the obstacle 114 does not block the light path between the mirror 116 and the fiber optic line 112. As a result, the reflected light 122 is at full or almost full intensity. However, upon detection of a casing collar 106, the obstacle 114 blocks the light path between the mirror 116 and the fiber optic line 112. As a result, the reflected light 122 is at reduced intensity, as represented by low-going pulses 202 in the timing diagram of FIG. 5. The reflected light 122 is received by a receiver 126 at the well surface, and processed by a data processing module 130. In this way, the position of the tool is accurately telemetered to the surface via the fiber optic line.

The relative position of the obstacle 114 and the mirror 116 can be switched, such that light is blocked when the casing collar locator is not in the vicinity of a casing collar 106, but light is allowed to pass through when the casing collar locator is in the vicinity of a casing collar.

In alternative embodiments, the interface components 110 can be used with tools other than the casing collar locator 104. Examples of other tools include other types of sensors, gamma ray tools, and so forth. Such a tool transmits predefined codes to represent respective events. In response to the codes, the mirror 116 and/or obstacle 114 are moved relative to each other by different distances, so that the reflected light 122 is modulated differently to represent the respective events.

Figure 6:
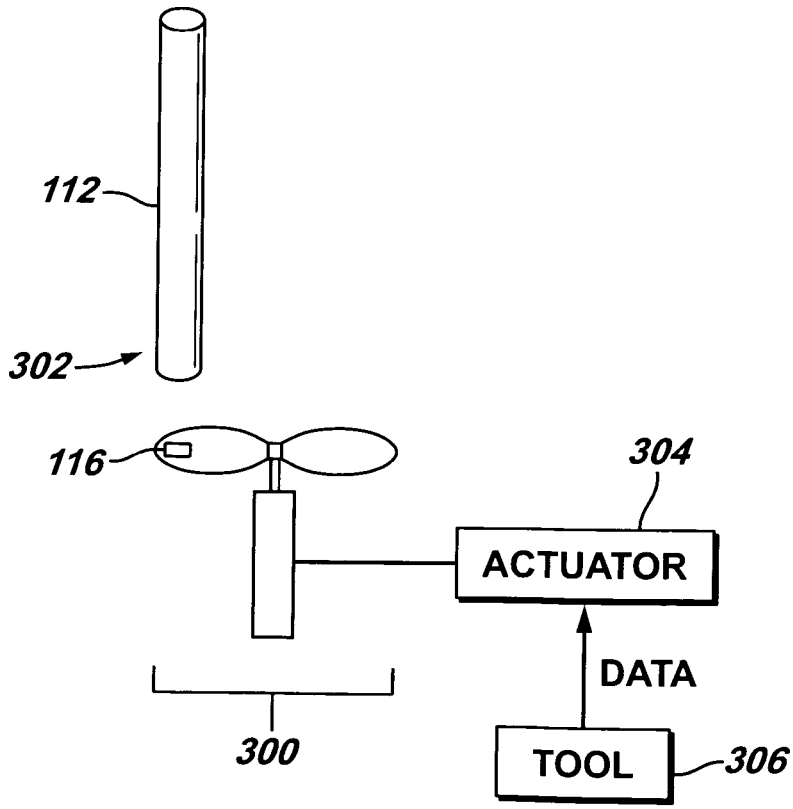
FIG. 6 is a schematic diagram of a tool including a spinner that is coupled to a fiber optic line, in accordance with another embodiment.

In yet another embodiment, as shown in FIG. 6, instead of using the obstacle 114, the mirror 116 is connected to a spinner 300 such that as the spinner 300 rotates, the mirror 116 passes by the lower end 302 of the fiber optic line 112 and reflects a pulse of light back to the surface. In this way, the rate of rotation of the spinner 300 may be determined. The spinner 300 may be controlled by an actuator 304 to control the rotational speed of the spinner 300 to thereby transmit modulated optical signals to the surface. Thus, different events corresponding to tool 306 cause the actuator 304 to rotate the spinner 300 at different speeds.

In another embodiment, the spinner 300 is exposed to well fluids and rotates in response to movement of the tool and/or flow of fluids past the spinner. By measuring the rate of rotation of the spinner 300, the flow rate of the fluid or speed of the tool may be determined.

Figure 7:
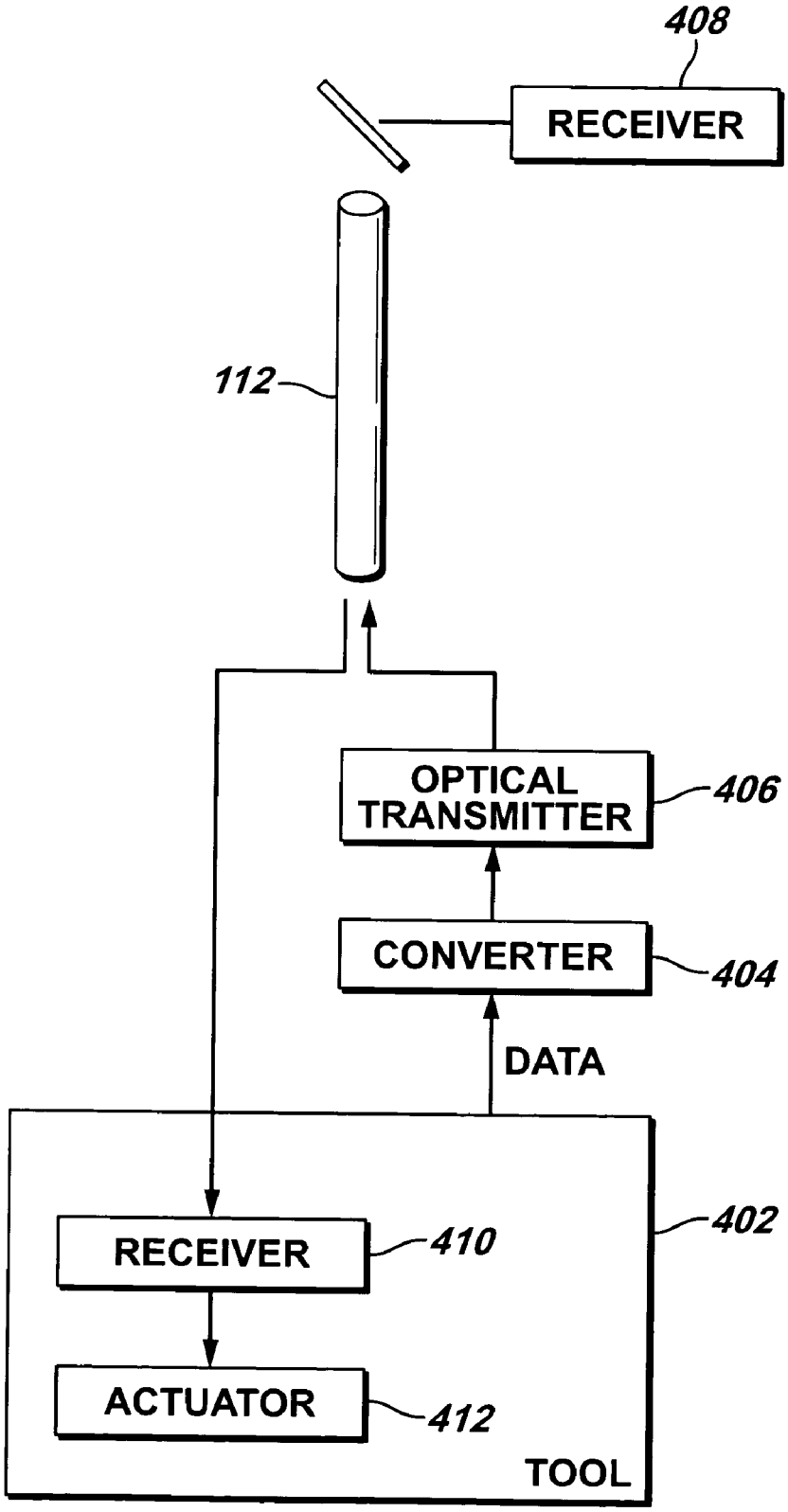
FIG. 7 is a schematic diagram of a system for sending actuation commands to a downhole tool through a fiber optic line, in accordance with a further embodiment.

The embodiments described above relate to a downhole tool string reflecting light transmitted by a well surface transmitter back to the surface. The reflected light is modulated to represent an event that has occurred downhole. This is the reflectometer configuration. In another configuration, the downhole tool string transmits coded optical signals up the fiber optic line to the well surface equipment. As shown in FIG. 7, a converter 404 is functionally attached to a tool 402. The converter 404 converts the electrical signals produced by the tool 402 into optical signals that are then transmitted by an optical transmitter 406 located downhole through the fiber optic line 112 to the surface. Data collected by the tool is thus converted into electrical signals which are then converted into optical signals by the converter 404 and transmitted in real time or otherwise to the surface by the optical transmitter 406. Other data, such as tool status reports (i.e., active/not active, battery power, malfunctioning), may also be sent from the tool 402 through the fiber optic line 112 to the surface on a real-time basis. At the well surface, a receiver 408 receives the optical signals over the fiber optic line 112.

The discussion above focuses on reporting data from a downhole tool to surface equipment over an fiber optic line carried in a conveyance structure. In other embodiments, the optical signals transmitted down the fiber optic line can also represent command signals for operating downhole tools. As further shown in FIG. 7, the tool 402 includes a receiver 420 to translate an optical signal to an electrical signal. An actuator 412 in the tool can be actuated based upon the optical signal received from the surface via the fiber optic line. The tool can be set upon receipt of the appropriate signal by electrically releasing an actuating piston to actuate the tool. For example, the tool can have a solenoid valve that opens to expose one side of the actuating piston to wellbore fluids to hydraulically actuate the tool. The tool can include a packer, anchor, valve or some other device. Alternatively, the tool can be set electrically using a downhole power source such as a battery, or can be powered by light.

In another example, the tool can include a valve or downhole sampler opened and closed using the electrical energy from the downhole power source. Alternatively, the tool can include a firing head or detonator for firing a perforating gun or a perforating gun itself that uses EFI (exploding foil initiator) detonators. In another example, the power source in the tool 402 can be an explosive power source that creates an increased pressure to move a piston or expand an element. Similarly, the power source can include a chemical reaction that is started upon receipt of an actuation signal by mixing of the chemicals. Mixing the chemicals causes an increase in pressure expansion, or some other change event.

In addition to enabling the transmission of the tool data, the fiber optic line 112 also provides a distributed temperature sensor that enables distributed temperature measurements to be taken along the length of the fiber optic line 112. To take distributed temperature measurements, pulses of light at a fixed wavelength are transmitted from the surface optical transmitter through the fiber optic line 112. At every measurement point in the line 112, light is back-scattered and returns to the surface equipment. Knowing the speed of light and the moment of arrival of the return signal enables its point of origin along the fiber optic line 112 to be determined. Temperature stimulates the energy levels of the silica molecules in the fiber optic line 112. The back-scattered light contains upshifted and downshifted wavebands (such as the Stokes Raman and Anti-Stokes Raman portions of the back-scattered spectrum) which can be analyzed to determine the temperature at origin. In this way, the temperature of each of the responding measurement points in the fiber optic line 14 can be calculated by the surface equipment, providing a complete temperature profile along the length of the fiber optic line 112. The surface equipment includes a distributed temperature measurement system receiver, which can include an optical time domain reflectrometry unit. The fiber optic line 112 can thus be used concurrently as a transmitter of data from a downhole tool, a transmitter of downhole tool activation signals, and as a sensor/transmitter of distributed temperature measurement.

In accordance with an embodiment, one application of the distributed temperature measurements using the fiber optic line is depth correlation. The distributed temperature readings are compared with the known temperature gradient of the well to determine the position of a tool in the well. In another embodiment, the reflection from the measurement point is used to determine the distance between the surface and the measurement point to determine the position of the tool in the well.

Figure 8:
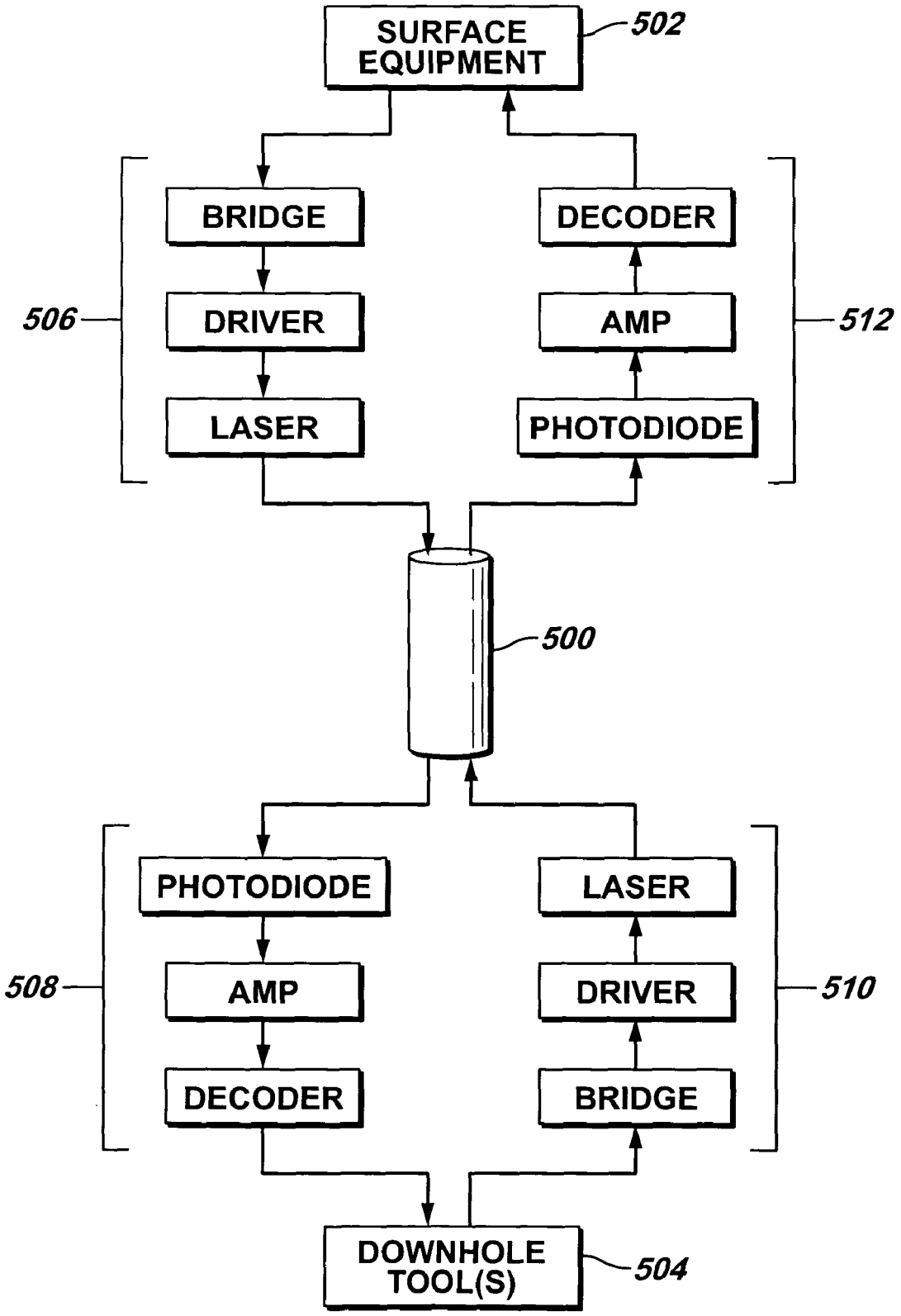
FIGS. 8–9 are schematic diagrams of systems to enable bi-directional communications over fiber optic line(s) carried in a conveyance structure according to some embodiments.

To enhance flexibility, bi-directional communications can be performed over the one or plural fiber optic lines carried in conveyance structures according to some embodiments. As shown in FIG. 8, two fiber optic lines 500 are used to enable bi-directional communications between surface equipment 502 and a downhole tool 504. The surface equipment 502 sends data to surface transmission equipment 506 (including a bridge, driver, and laser), which transmits optical signals down one of the fiber optic lines 500. The transmitted optical signals are received by downhole receiving equipment 508 (including a photodiode, amplifier, and decoder), which converts the received optical signals to commands sent to the downhole tool 504.

On the return side, the downhole tool 504 sends data to downhole transmission equipment 510, which converts the data to optical signals that are sent up a fiber optic line 500. The signals from the downhole transmission equipment 510 are received by surface receiving equipment 512, which converts the received optical signals to data sent to the surface equipment 502.

Figure 9:
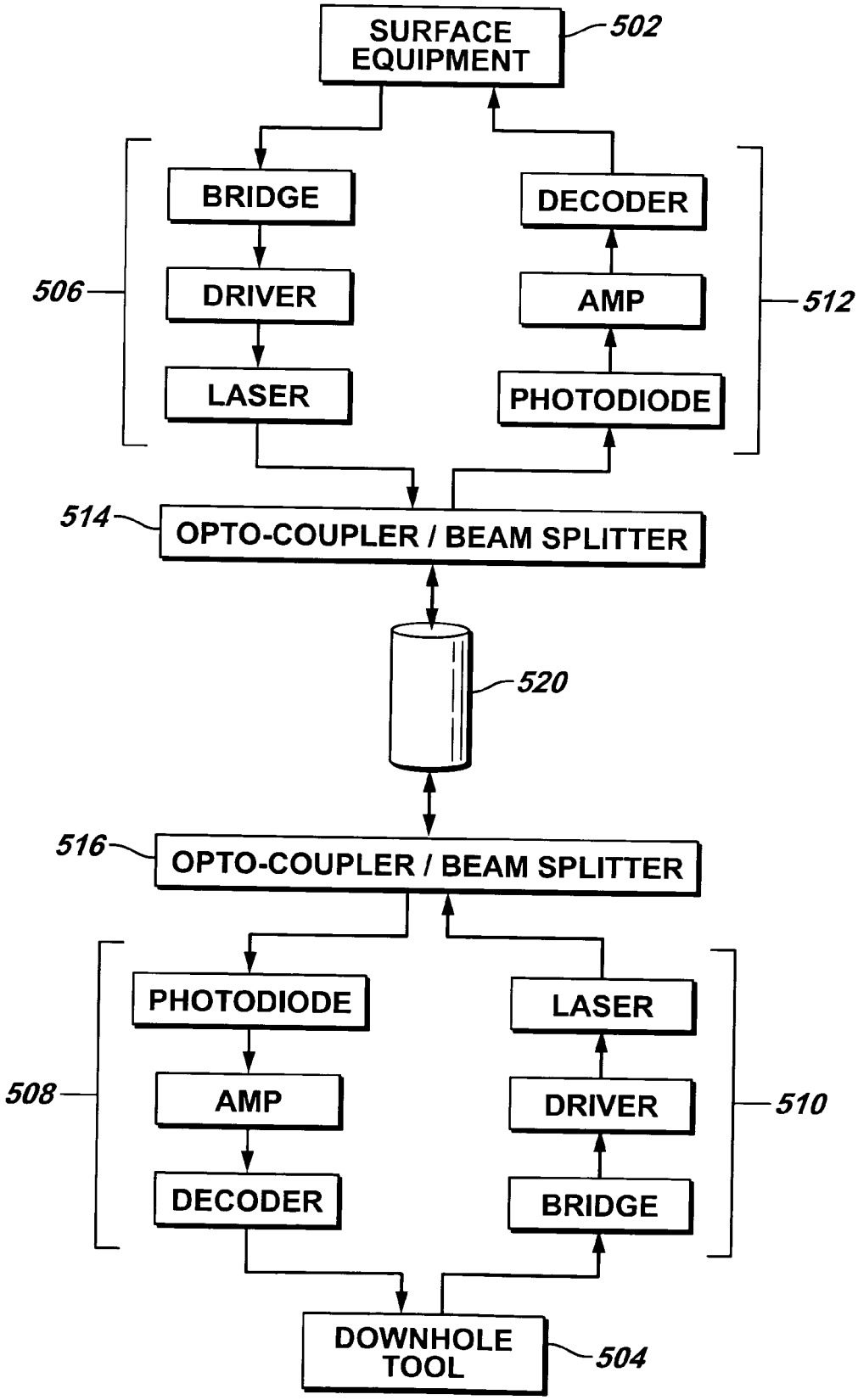

FIG. 9 depicts a different arrangement in which bi-directional communications are performed over a single fiber optic line 520 (instead of plural fiber optic lines). In this case, opto-couplers or beam splitters 514 and 516 are added at the two ends of the fiber optic line 520.

To further enhance flexibility, wavelength-division multiplexing (WDM) can be employed. WDM increases the number of channels for communicating over the fiber optic line. Optical signals of different wavelengths are multiplexed onto the fiber optic line.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. An apparatus for use in a well, comprising:

a slickline having a fiber optic line therein;

a tool attached to the slickline, wherein the tool comprises a sensor; and a modulator to modulate optical signals to represent a well characteristic detected by the sensor, wherein the sensor comprises a casing collar locator, and wherein the modulator comprises a reflective device and an element to modulate light reflected from the reflective device to the fiber optic line.

2. The apparatus of claim 1, wherein the element comprises a spinner, and the reflective device is connected to the spinner.

3. The apparatus of claim 1, wherein the element comprises an obstacle that is movable with respect to the reflective device.

4. An apparatus for use in a well, comprising:

a slickline having a fiber optic line therein;

a tool attached to the slickline, wherein the tool comprises a sensor; and a modulator to modulate optical signals to represent a well characteristic detected by the sensor, wherein the modulator comprises an obstacle and a reflective device, the obstacle and reflective device movable with respect to each other to modulate the optical signals.

5. The apparatus of claim 4, wherein the slickline comprises a bore through which the fiber optic line extends.

6. The apparatus of claim 5, further comprising another fiber optic line that extends through the bore of the slickline.

7. The apparatus of claim 4, further comprising longitudinally-extending support structures to add strength to the slickline.

8. The apparatus of claim 7, wherein the longitudinally-extending support structures include support fibers.

9. The apparatus of claim 4, wherein the obstacle and the reflective device have at least two relative positions, the obstacle blocking at least a portion of reflected light from the reflective device in response to the obstacle and the reflective device being at a first relative position, and the obstacle to allow a greater amount of reflected light to pass from the reflective device to the fiber optic line in response to the obstacle and the reflective device being at a second position.

10. The apparatus of claim 9, wherein the reflective device comprises a mirror.

11. The apparatus of claim 4, wherein the obstacle modulates an amount of reflected light transmitted by the reflective device to the fiber optic line.

12. The apparatus of claim 11, wherein the reflective device is adapted to receive transmitted light transmitted by an optical transmitter into the fiber optic line, and to reflect the received light as the reflected light.

13. The apparatus of claim 4, wherein the tool is adapted to receive an actuation command through the fiber optic line.

14. The apparatus of claim 4, wherein the slickline is adapted to support a weight of greater than or equal to 500 pounds.

15. The apparatus of claim 4, wherein the slickline is a conveyance structure without an electrical conductor to communicate power or data.

16. The apparatus of claim 4, wherein the slickline is a conveyance structure that does not communicate power or data separate from the fiber optic line.

17. The apparatus of claim 4, wherein the tool comprises an optical transmitter to transmit optical signals over the fiber optic line.

18. The apparatus of claim 4, wherein the obstacle comprises a magnet.

19. The apparatus of claim 4, further comprising an actuator to move at least one of the obstacle and reflective device in response to a predetermined condition in the well.

20. The apparatus of claim 19, further comprising a casing collar locator, wherein the actuator receives data from the casing collar locator to move the at least one of the obstacle and reflective device.

21. An apparatus comprising:

a conveyance structure for inserting or removing a tool into or out of a wellbore;

a fiber optic line extending through the conveyance structure;

the conveyance structure not being used to transmit power or data therethrough separate from the fiber optic line, wherein the conveyance structure comprises a conveyance tube, wherein the conveyance tube has a diameter less than about 0.5 inch;

a sensor coupled to the fiber optic line; and a modulator to modulate optical signals to represent a well characteristic detected by the sensor, the modulator comprising a reflective device and an element to modulate light reflected from the reflective device to the fiber optic line.

22. The apparatus of claim 21, wherein the conveyance structure comprises a bore through which the fiber optic line extends.

23. The apparatus of claim 21, further comprising another fiber optic line disposed in the conveyance structure.

24. The apparatus of claim 21, wherein the element comprises an obstacle that is movable with respect to the reflective device.

25. An apparatus comprising:

a conveyance structure for inserting or removing a tool into or out of a wellbore;

a fiber optic line extending through the conveyance structure;

the conveyance structure not being used to transmit power or data therethrough separate from the fiber optic line; and a modulator to modulate optical signals to represent an event associated with the tool, wherein the modulator comprises an obstacle and a reflective device, the obstacle and reflective device movable with respect to each other to modulate the optical signals.

26. The apparatus of claim 25, wherein the obstacle modulates an amount of reflected light transmitted by the reflective device to the fiber optic line.

27. The apparatus of claim 26, wherein the reflective device is adapted to receive transmitted light transmitted by an optical transmitter into the fiber optic line, and to reflect the received light as the reflected light.

* * * * *